US006361154B1

(12) United States Patent
Watanabe et al.

(10) Patent No.: US 6,361,154 B1
(45) Date of Patent: Mar. 26, 2002

(54) INK-JET HEAD WITH PIEZOELECTRIC ACTUATOR

(75) Inventors: Osamu Watanabe; Kenji Tomita, both of Kumamoto; Isaku Kanno, Nara; Ryoichi Takayama, Osaka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/385,842

(22) Filed: Aug. 30, 1999

(30) Foreign Application Priority Data

Sep. 3, 1998 (JP) ..... 10-249511

(51) Int. Cl.[7] ..... B41J 2/045
(52) U.S. Cl. ..... 347/70
(58) Field of Search ..... 347/68, 54, 20, 347/70

(56) References Cited

U.S. PATENT DOCUMENTS

| | | | | |
|---|---|---|---|---|
| 4,303,927 A | | 12/1981 | Tsao | |
| 4,539,575 A | | 9/1985 | Nilsson | |
| 4,635,079 A | | 1/1987 | Hubbard | |
| 5,767,612 A | * | 6/1998 | Takeuchi et al. | 310/324 |
| 6,053,600 A | * | 4/2000 | Hotomi | 347/68 |
| 6,130,689 A | * | 10/2000 | Choi | 347/54 |
| 6,217,158 B1 | * | 4/2001 | Kanaya et al. | 347/70 |

FOREIGN PATENT DOCUMENTS

| | | |
|---|---|---|
| JP | 6-204580 | 7/1994 |
| JP | 10-34922 | 2/1998 |

* cited by examiner

*Primary Examiner*—Judy Nguyen
(74) *Attorney, Agent, or Firm*—Eric J. Robinson; Nixon Peabody LLP

(57) ABSTRACT

An ink jet including a head body including plural pressure chamber concaves each having a supply port for supplying ink and a discharge port for discharging ink, and a piezoelectric actuator including mutually electrically connected vibration plates that cover the concaves of the head body in order to form pressure chambers together with the concaves and are separately provided correspondingly to one or plural pressure chambers, piezoelectric device respectively provided on surfaces of the vibration plates opposite to the pressure chambers correspondingly to the pressure chambers and individual electrodes respectively provided on surfaces of said piezoelectric devices opposite to said vibration plates for applying a voltage to said piezoelectric devices together with said vibration plates. The vibration plates are deformed in a manner that volumes of the pressure chambers are decreased by applying a voltage to the piezoelectric devices through the vibration plates and the individual electrodes, whereby ink contained in the pressure chambers is discharged through the discharge ports. Additionally, a portion of each of the vibration plates corresponding to each of the pressure chambers is bent into a convex projecting toward an opposite direction to the corresponding pressure chamber due to a compressive internal stress action of each of the piezoelectric devices.

6 Claims, 10 Drawing Sheets

INK-JET HEAD WITH PIEZOELECTRIC ACTUATOR

BACKGROUND OF THE INVENTION

The present invention relates to an ink-jet head for use in an ink-jet printer, and more particularly, it relates to improvement of a vibration plate of a piezoelectric actuator used for discharging ink in an ink-jet head.

Recently, ink-jet printers are widely used in offices and households. Various systems have been proposed for ink-jet heads used in the ink-jet printers in order to meet recent demands for low noise and high print quality. In general, the systems for the ink-jet heads can be roughly divided into the following two systems:

In a first system, part of an ink passage and an ink chamber is formed into a pressure chamber by using a piezoelectric actuator having a piezoelectric device, and a pulse voltage is applied to the piezoelectric device so as to deform the piezoelectric actuator. Thus, the pressure chamber is deformed to have a smaller volume, thereby generating a pressure pulse within the pressure chamber. By using the pressure pulse, ink drops are jetted through a nozzle hole communicating with the pressure chamber.

In a second system, an exothermic resistance is provided in an ink passage, and a pulse voltage is applied to the exothermic resistance so as to generate heat therein. Thus, ink contained in the passage is boiled with vapor bubble generated. By using the pressure of the vapor bubble, ink drops are jetted through a nozzle hole.

The present invention relates to an ink-jet head of the first system, and hence, this system will be further described in detail. FIGS. 11 through 13 show an exemplified conventional ink-jet head of the first system, and the ink-jet head comprises a head body 101 including a plurality of pressure chamber concaves 102 each having a supply port 102*a* for supplying ink and a discharge port 102*b* for discharging ink. The concaves 102 of the head body 101 are arranged along one direction at predetermined intervals.

The head body 101 includes a pressure chamber part 105 forming the side walls of the concaves 102, an ink passage part 106 forming the bottoms of the concaves 102 and including plurality of thin plates adhered to one another, and a nozzle plate 113. Within the ink passage part 106, an ink supply passage 107 communicating with the supply port 102*a* of each concave 102 and an ink discharge passage 108 communicating with the discharge port 102*b* of each concave 102 are formed. Each ink supply passage 107 communicates with an ink supply chamber 110 extending in the direction of arranging the concaves 102, and the ink supply chamber 110 communicates with an ink supply hole 111 formed in the pressure chamber part 105 and the ink passage part 106 and connected with an external ink tank (not shown). In the nozzle plate 113, nozzle holes 114 respectively connected with the ink discharge passages 108 are formed.

On the upper surface of the pressure chamber part 105 of the head body 101, a piezoelectric actuator 121 is disposed. The piezoelectric actuator 121 includes one flat vibration plate 122 that covers all the concaves 102 of the head body 101 so as to form pressure chambers 103 together with the concaves 102. The vibration plate 122 also works as a common electrode shared by all piezoelectric devices 123 described below. Also, the piezoelectric actuator 121 includes the piezoelectric devices 123 disposed on the vibration plate 122 respectively correspondingly to the pressure chambers 103 and individual electrodes 124 respectively disposed on the piezoelectric devices 123 for applying a voltage to the piezoelectric devices 123.

When a pulse voltage is applied between the vibration plate 122 serving as the common electrode and each individual electrode 124, each piezoelectric device 123 shrinks in a lateral direction perpendicular to a thickness direction, but the vibration plate 122 and the individual electrode 124 do not shrink. Therefore, a portion of the vibration plate 122 corresponding to the piezoelectric device 123 is deformed into a convex projecting toward the pressure chamber 103 due to so-called the bimetal effect. This deformation causes a pressure within the pressure chamber 103, and owing to the pressure, ink contained in the pressure chamber 103 is jetted from the nozzle hole 114 through the discharge port 102*b* and the ink discharge passage 108.

In the ink-jet head for jetting ink by using the piezoelectric actuator as described above, various improvements have been recently made so as to meet strict demands for compactness and light weight, a low driving voltage, low noise, low cost, and high controllability in jetting ink. In order to attain further compactness and higher performance, the vibration plate, the piezoelectric devices and the like can be formed from thin films easily subjected to refined processes.

When the vibration plate and the piezoelectric devices are simply made from thin films with keeping the shape and the structure of the conventional piezoelectric actuator, however, there is a fear of occurrence of cracks and film peeling in the vibration plate and the piezoelectric devices in manufacture of the ink-jet head. As a result, the productivity of the ink-jet head is disadvantageously lowered. Accordingly, an ink-jet head that is not only compact but also can be easily manufactured with good productivity is desired.

The present invention was devised under these circumstances. An object of the invention is, in an ink-jet head for jetting ink contained in a pressure chamber by using a piezoelectric actuator, changing the structure of a vibration plate of the piezoelectric actuator so as to make compact the ink-jet head by forming a vibration plate and piezoelectric devices from thin films as well as to improve the productivity as far as possible by suppressing occurrence of cracks and the like in the vibration plate and the piezoelectric devices.

SUMMARY OF THE INVENTION

In order to achieve the aforementioned object, according to the invention, vibration plates are separately provided correspondingly to one or plural pressure chambers, or a portion of a vibration plate corresponding to each pressure chamber is bent into a convex projecting in an opposite direction to the pressure chamber.

Specifically, the ink-jet head of this invention comprises a head body including plural pressure chamber concaves each having a supply port for supplying ink and a discharge port for discharging ink; and a piezoelectric actuator including mutually electrically connected vibration plates that cover the concaves of the head body in order to form pressure chambers together with the concaves and are separately provided correspondingly to one or plural pressure chambers; piezoelectric devices respectively provided on surfaces of the vibration plates opposite to the pressure chambers correspondingly to the pressure chambers; and individual electrodes respectively provided on surfaces of the piezoelectric devices opposite to the vibration plates for applying a voltage to the piezoelectric devices together with the vibration plates, wherein the vibration plates are deformed in a manner that volumes of the pressure chambers are decreased by applying a voltage to the piezoelectric devices through the vibration plates and the individual electrodes, whereby ink contained in the pressure chambers is discharged through the discharge ports.

In this manner, the vibration plates are separately provided correspondingly to one or plural pressure chambers. Therefore, the separated vibration plates can be prevented from affecting one another in their internal stress and strain, and hence, the internal stress caused in each vibration plate can be reduced as compared with the case where one vibration plate covers all the concaves of the head body. As a result, the internal stress caused in the piezoelectric device and the individual electrode disposed on the surface of the vibration plate opposite to the pressure chamber can be also reduced. Accordingly, even when the vibration plate, the piezoelectric device and the like are formed from thin films, the occurrence of cracks and film peeling in the vibration plate, the piezoelectric device and the like can be prevented in the manufacture of the ink-jet head, resulting in improving the productivity. Furthermore, the separated vibration plates do not mutually affect in their deformation in use of the ink-jet head, and hence, the mechanical strength of the vibration plate can be prevented from lowering, resulting in elongating the life of the ink-jet head.

In the ink-jet head, a portion of each of the vibration plates corresponding to each of the pressure chambers is preferably bent into a convex projecting toward an opposite direction to the corresponding pressure chamber.

Specifically, owing to a difference in the thermal expansion coefficient between the vibration plate and the piezoelectric device (which is larger in the vibration plate), the vibration plate shrinks more largely than the piezoelectric device but the piezoelectric device hardly shrinks. Accordingly, the vibration plate can be easily bent into a convex projecting toward the opposite direction to the pressure chamber. In this shrinkage, the vibration plate receives a tensile force from the piezoelectric device and the piezoelectric device receives a compressive force from the vibration plate, and hence, compressive internal stress is caused in the piezoelectric device. Thus, the occurrence of cracks and the like particularly in the piezoelectric device very weak against a tensile force can be more effectively suppressed. Furthermore, in use of the ink-jet head, due to the shrinkage of the piezoelectric device, the portion of the vibration plate corresponding to the pressure chamber is deformed to have a smaller convex dimension toward the opposite direction to the pressure chamber. Therefore, the piezoelectric device receives a tensile force from the vibration plate. However, since the compressive force is initially caused as described above, the tensile force and the compressive force cancel each other, so as to make the stress caused in the piezoelectric device comparative small. In addition, even when the deformation is small, the power for jetting ink can be larger than in the case where the vibration plate is in the shape of a flat plate or bent into a convex projecting toward the pressure chamber. Therefore, large deformation is not necessary. Also in consideration of this small deformation, the stress caused in deforming the vibration plate and the piezoelectric device can be reduced.

When the vibration plate is bent as described above, the convex projecting toward the opposite direction to the pressure chamber preferably has a maximum dimension of 0.05 through 10 $\mu$m.

When the maximum convex dimension is smaller than 0.05 $\mu$m, an effect to suppress failures of the vibration plate and the piezoelectric device during manufacture and use of the ink-jet head cannot be sufficiently exhibited. When the maximum convex dimension is larger than 10 $\mu$m, cracks can be more easily caused in the vibration plate and the piezoelectric device during the manufacture on the contrary. Accordingly, the maximum convex dimension is preferably set to 0.05 through 10 $\mu$m. In this manner, the productivity of the ink-jet head can be maximized.

Alternatively, the ink-jet head of this invention comprises a head body including plural pressure chamber concaves each having a supply port for supplying ink and a discharge port for discharging ink; and a piezoelectric actuator including a vibration plate covering the concaves of the head body in order to form pressure chambers together with the concaves and having a convex in a portion corresponding to each of the pressure chambers, the convex projecting toward an opposite direction to the corresponding pressure chamber; piezoelectric devices provided on a surface of the vibration plate opposite to the pressure chambers respectively correspondingly to the pressure chambers; and individual electrodes respectively provided on surfaces of the piezoelectric devices opposite to the vibration plate for applying a voltage to the piezoelectric devices together with the vibration plate, wherein the vibration plate is deformed in a manner that volumes of the pressure chambers are decreased by applying a voltage to the piezoelectric devices through the vibration plate and the individual electrodes, whereby ink contained in the pressure chambers is discharged through the discharge ports.

Owing to this structure, even when the vibration plate, the piezoelectric device and the like are formed from thin films, the occurrence of cracks and the like in the piezoelectric device in particular can be suppressed in the manufacture of the ink-jet head because compressive internal stress is caused in the piezoelectric device as described above. In addition, in use of the ink-jet head, the stress caused in deforming the vibration plate and the piezoelectric device can be reduced, resulting in elongating the life of the ink-jet head.

Also in this ink-jet head, the convex of the vibration plate projecting toward the opposite direction to the corresponding pressure chamber preferably has a maximum dimension of 0.05 through 10 $\mu$m for the same reason as described above.

DETAILED DESCRIPTION OF THE INVENTION

Now, preferred embodiments of the invention will be described on the basis of the accompanying drawings.

Figure 1:
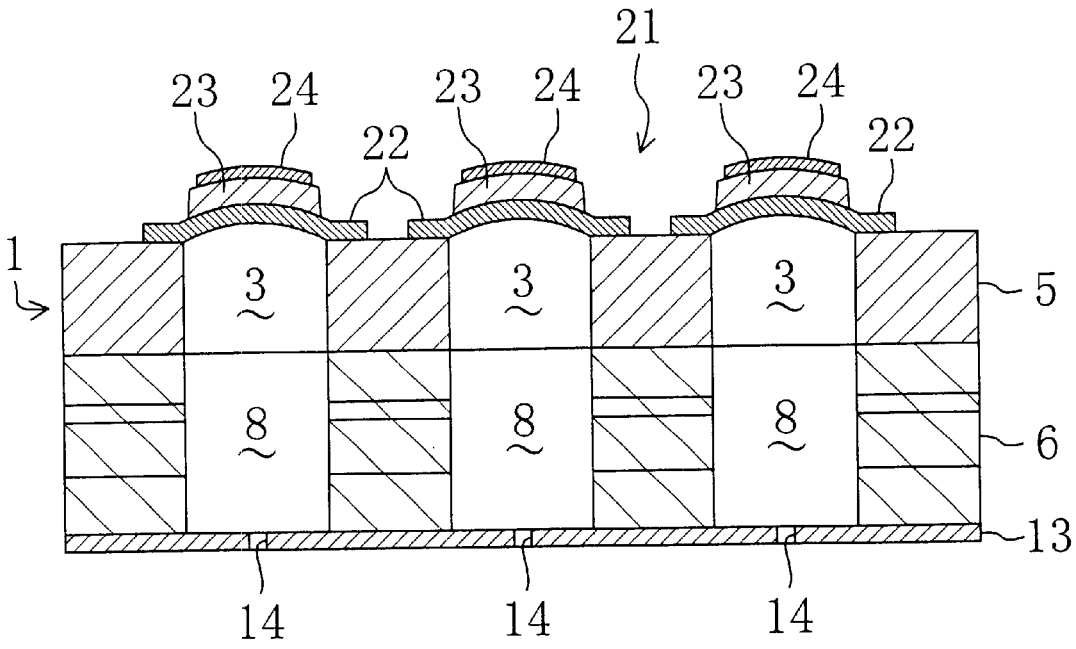
FIG. 1 is a sectional view of an ink-jet head according to an embodiment of the invention taken along a lateral direction of a vibration plate (specifically, line I—I of FIG. 3)
Figure 2:
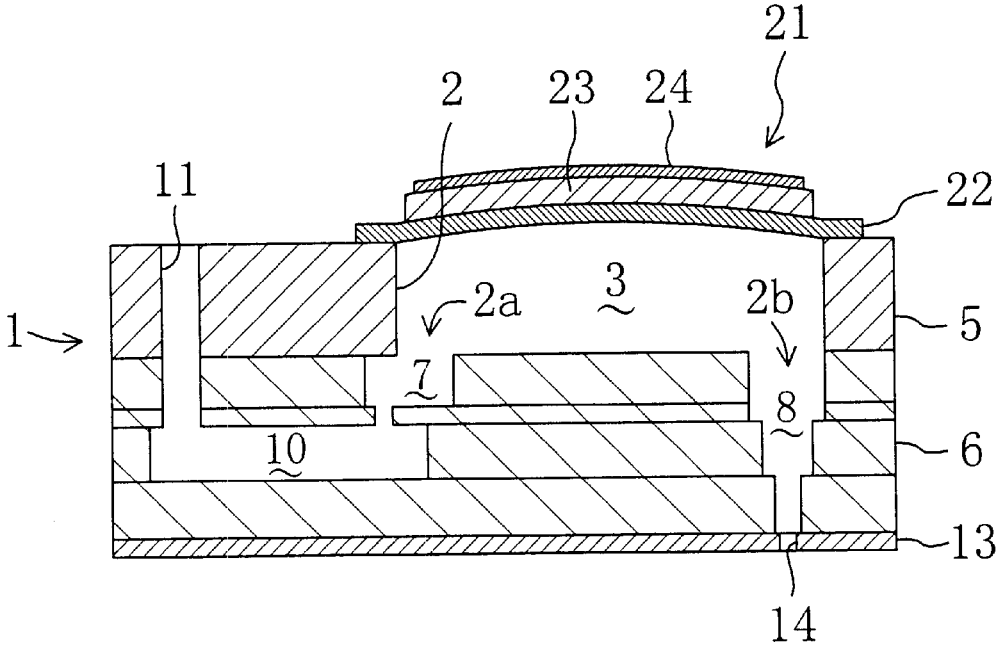
FIG. 2 is a sectional view of the ink-jet head taken along a longitudinal direction of the vibration plate (specifically, line II—II of FIG. 3)
Figure 3:
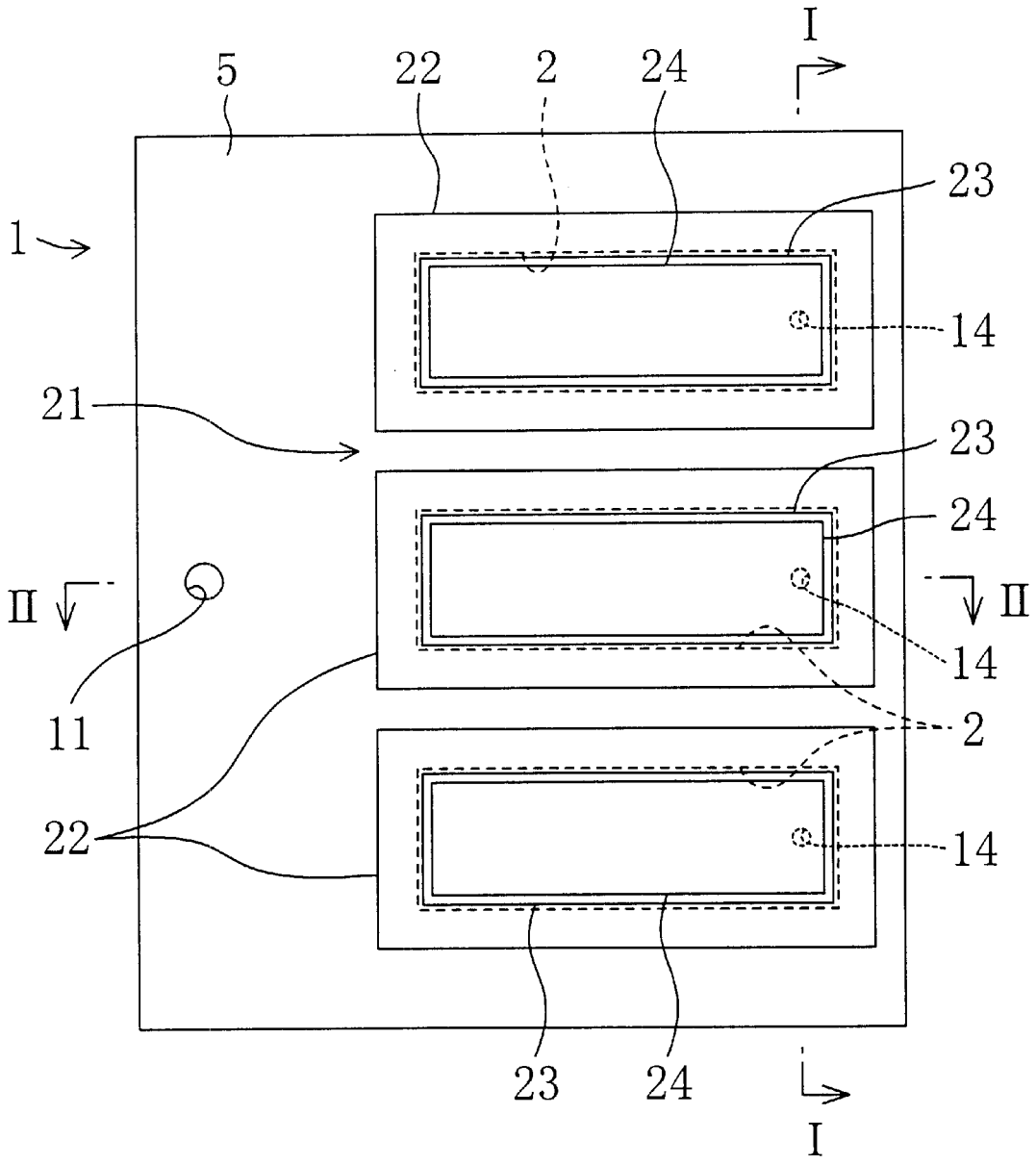
FIG. 3 is a plan view of the ink-jet head.
Figure 4A:
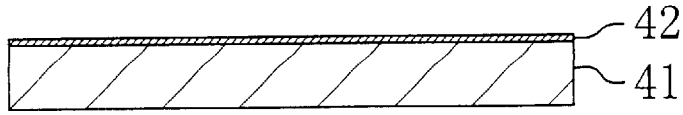
FIG. 4(*a*) through 4(*f*) are schematic diagrams for showing a method of manufacturing the ink-jet head.
Figure 4B:
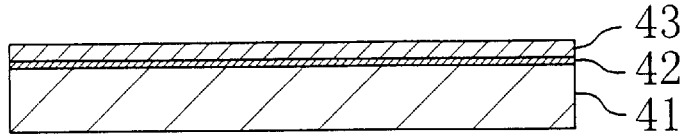
Figure 4C:
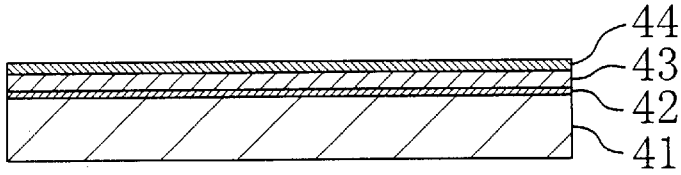
Figure 4D:
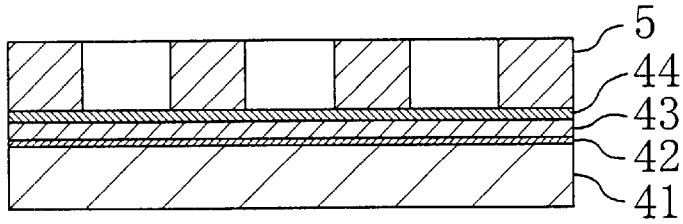
Figure 4E:
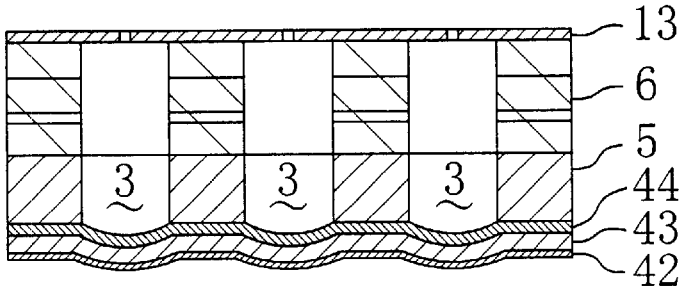
Figure 4F:
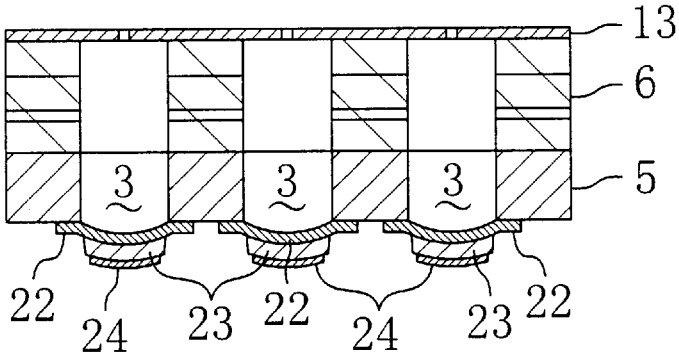

FIGS. 1 through 3 show an ink-jet head according to an embodiment of the invention. The ink-jet head comprises a head body 1 including plural pressure chamber concaves 2 each having a supply port 2*a* for supplying ink and a discharge port 2*b* for discharging ink. The respective concaves 2 of the head body 1 are formed on one surface (upper surface) of the head body 1 in a substantially rectangular shape and arranged along one direction at predetermined intervals. In FIG. 3, merely three concaves 2 (each including a nozzle hole 14, a vibration plate 22, a piezoelectric device 23 and an individual electrode 24 described below) are shown for the sake of simplification, but a large number of concaves are actually formed.

The side walls of each concave 2 of the head body 1 are made from a pressure chamber part 5 of photosensitive glass with a thickness of approximately 200 μm, and the bottom of the concave 2 is made from an ink passage part 6 fixed on the pressure chamber part 5 and including plural stainless steel thin plates adhered to one another. In the ink passage part 6, an ink supply passage 7 communicating with the supply port 2*a* of each concave 2 and an ink discharge passage 8 communicating with the discharge port 2*b* are formed. The ink supply passage 7 communicates with an ink supply chamber 10 extending in the direction of arranging the concaves 2, and the ink supply chamber 10 communicates with an ink supply hole 11 formed in the pressure chamber part 5 and the ink passage part 6 and connected with an external ink tank (not shown). On the surface of the ink passage part 6 opposite to the pressure chamber part 5 (namely, on the lower surface), a nozzle plate 13 of a polymer resin, such as polyimide, with a thickness of approximately 20 μm is provided. In the nozzle plate 13, nozzle holes 14 each with a diameter of approximately 20 μm are formed so as to be respectively connected with the ink discharge passages 8. The nozzle holes 14 are linearly arranged in the direction of arranging the concaves 2.

On the surface of the pressure chamber part 5 of the head body 1 opposite to the ink passage part 6 (namely, on the upper surface), a piezoelectric actuator 21 is disposed. The piezoelectric actuator 21 includes vibration plates 22 of Cr with a thickness of 1 through 3 μm separately provided correspondingly to the respective concaves 2 of the head body 1 so as to cover the concaves 2 and form pressure chambers 3 together with the concaves 2. Each vibration plate 22 has a rectangular shape substantially the same as the shape of the pressure chamber 3 on a plan view, and the respective vibration plates 22 are mutually electrically connected through wires (not shown), so as to work as a common electrode shared by all piezoelectric devices 23 described below.

The piezoelectric actuator 21 includes a piezoelectric device 23 of lead zirconate titanate (PZT) with a thickness of 2 through 5 μm provided correspondingly to each pressure chamber 3 on the surface (upper surface) of each vibration plate 22 opposite to the corresponding pressure chamber 3, and an individual electrode 24 of Pt with a thickness of 0.1 μm provided on the surface (upper surface) of each piezoelectric device 23 opposite to the vibration plate 22 for applying a voltage to the piezoelectric device 23 together with the vibration plate 22.

A portion of each vibration plate 22 corresponding to the pressure chamber 3 is bent into a convex projecting toward the opposite direction to the corresponding pressure chamber 3 (namely, upward). In other words, the portion of the vibration plate 22 corresponding to the pressure chamber 3 projects in a substantially arcuate shape toward the opposite direction to the corresponding pressure chamber 3 in both sections taken along a lateral direction and a longitudinal direction of the vibration plate 22. In accordance with the bent of the vibration plate 22, each piezoelectric device 23 and each individual electrode 24 are bent upward. The maximum convex dimension of the portion of the vibration plate 22 corresponding to the pressure chamber 3 projecting toward the opposite direction to the pressure chamber 3 (namely, a convex dimension at substantially the center of each vibration plate 22) is preferably set to 0.05 through 10 μm. When the maximum convex dimension is smaller than 0.05 μm, an effect to suppress failures of the vibration plate 22 and the piezoelectric device 23 during manufacture and use of the ink-jet head cannot be sufficiently exhibited as described below. When the maximum convex dimension is larger than 10 μm, cracks can be more easily caused in the vibration plate 22 and the piezoelectric device 23 during manufacture on the contrary. The maximum convex dimension is more preferably 0.05 through 5 μm.

Next, procedures for manufacturing the ink-jet head will be described with reference to FIGS. 4(*a*) through 4(*f*). In FIGS. 4(*a*) through 4(*f*), the ink-jet head is shown upside down, namely, inversely to that shown in FIGS. 1 and 2.

First, a Pt film 42 is formed on the entire surface of a filming substrate 41 of MgO by sputtering as is shown in FIG. 4(*a*). Then, a PZT film 43 is formed on the entire Pt film 42 by the sputtering as is shown in FIG. 4(*b*). Thereafter, a Cr film 44 is formed on the entire PZT film 43 by the sputtering as is shown in FIG. 4(*c*). The sputtering is a technique to form a thin film by utilizing a phenomenon (designated as sputter) that when a solid (target) is irradiated with highly energetic particles, composing atoms of the target are released from the surface of the target. The sputtering can be conducted by a variety of methods, such as high frequency sputtering and DC sputtering, depending upon the structure of an electrode and the method of generating sputtering particles. Among these methods, sputtering by using high frequency (a frequency of 13.56 MHZ) discharge is preferred because electrification of a positive potential on the surface of an insulating target can be avoided in this sputtering and hence the sputtering can be conducted even on an insulating target.

In forming the Cr film 44 by the sputtering, the membrane stress of the Cr film 44 can be controlled by changing parameters of the sputtering conditions, such as a temperature of the filming substrate 41, a sputtering gas pressure, sputtering power and a TS distance (a distance between a target and a substrate), and preferably by changing the sputtering gas pressure. Therefore, the Cr film 44 is preferably set to have a compressive force as the initial stress by thus controlling the sputtering gas pressure and the like. For example, by using a high frequency sputtering system and setting a target diameter to 6 inches, sputtering power to 300 W and a sputtering argon gas pressure to 2 mTorr (0.27 Pa), the Cr film 44 can be set to have a compressive force as the initial stress. The membrane stress of the Cr film 44 can be obtained by previously measuring a warp in a thin substrate (with a dimension of 18 mm×4 mm and a thickness of 0.1 mm) having known Young's modulus and Poisson's ratio and bearing a Cr thin film formed thereon, and calculating the membrane stress of the thin film formed on the substrate in accordance with bending beam relational expressions. Also, the stress can be identified as a compressive force or a tensile force depending upon whether the thin film formed on the substrate becomes concave or convex.

Subsequently, on the Cr film 44, the pressure chamber part 5 of the head body 1 is fixed as is shown in FIG. 4(*d*). Then, the filming substrate 41 is melted and removed with heated phosphoric acid or KOH, and the ink passage part 6 and the nozzle plate 13 previously integrated are fixed on the pressure chamber part 5 as is shown in FIG. 4(*e*). When the filming substrate 41 is thus removed, portions of the PZT film 43 and the Cr film 44 corresponding to the pressure chamber 3 (namely, portions not constrained by the pressure chamber part 5) are bent into a convex projecting toward the opposite direction to the pressure chamber 3 owing to a difference in the thermal expansion coefficient between the PZT film 43 and the Cr film 44 (which is larger in the Cr film 44). The Pt film 42 is much thinner than the PZT film 43 and the Cr film 44, and hence hardly affects the direction of the bent. In other words, since the Cr film 44 having a larger thermal expansion coefficient shrinks more largely than the PZT film 43 and the PZT film 43 hardly shrinks, the portions are bent to have a convex on the side of the PZT film 43. This is the same as in the case where when a bimetal of Fe and Al is heated, the bimetal is bent to have a convex on the side of Al because Al having a larger thermal expansion coefficient elongates more largely than Fe. In this shrinkage, the Cr film 44 receives a tensile force from the PZT film 43 and the PZT film 43 receives a compressive force from the Cr film 44. When the Cr film 44 is appropriately provided with initial compressive strain by controlling the sputtering gas pressure and the like as described above, the vibration plate 22 can be prevented from being excessively bent, so that the maximum convex dimension can be set to 0.05 through 10 $\mu$m.

Subsequently, the Pt film 42, the PZT film 43 and the Cr film 44 are separated correspondingly to the respective pressure chambers 3 by dry etching such as ion milling and reactive ion etching, thereby forming the individual electrodes 24, the piezoelectric devices 23 and the vibration plates 22 as is shown in FIG. 4(*f*). In this manner, the separated vibration plates 22 can be prevented from affecting one another in their internal stress and strain, and the stress is relaxed so that the internal stress within each vibration plate 22 can be smaller as compared with the case where one vibration plate 22 covers all the concaves 2 of the head body 1. As a result, the internal stress caused in the piezoelectric device 23 and the individual electrode 24 provided on the surface of the vibration plate 22 opposite to the pressure chamber 3 can be also reduced. When the ion milling is adopted as the dry etching, an argon gas is preferably used in consideration of reactivity, and when the reactive ion etching is adopted, $O_2$, $CF_4$ or $CCl_4$ is preferably used also in consideration of reactivity.

Subsequently, although not shown in the drawings, wiring of the vibration plates 22 and the individual electrodes 24 and other necessary processes are conducted, resulting in completing the ink-jet head.

Since the vibration plates 22 are thus separately provided to the respective pressure chambers 3, the internal stress caused within the vibration plates 22 and the piezoelectric devices 23 can be reduced as described above. Therefore, even when the vibration plates 22 and the piezoelectric devices 23 are formed from thin films, the occurrence of cracks and film peeling in the vibration plates 22 and the piezoelectric devices 23 can be suppressed in the manufacture of the ink-jet head. Furthermore, since the portion of each vibration plate 22 corresponding to the pressure chamber 3 is bent into a convex projecting toward the opposite direction to the pressure chamber 3, a compressive force is applied to the piezoelectric device 23 that is weak against a tensile force, and hence, the occurrence of cracks in the piezoelectric devices 23 in particular can be more effectively suppressed. Accordingly, while downsizing the ink-jet head, the productivity can be improved.

Figure 5A:
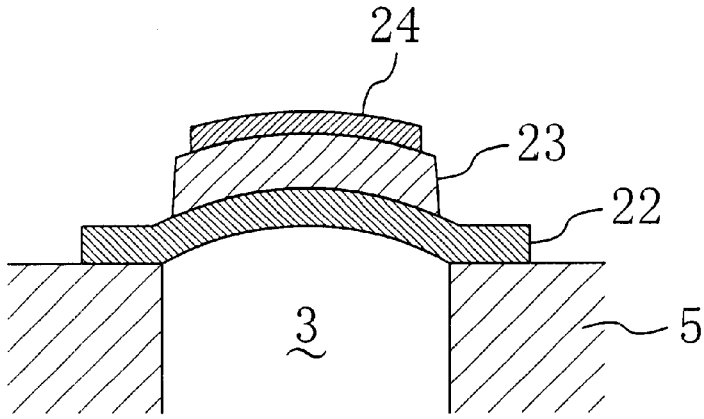
FIGS. 5(*a*) and 5(*b*) are enlarged views of a main part of the vibration plate for showing a difference between a non-deformed state and a deformed state.
Figure 5B:
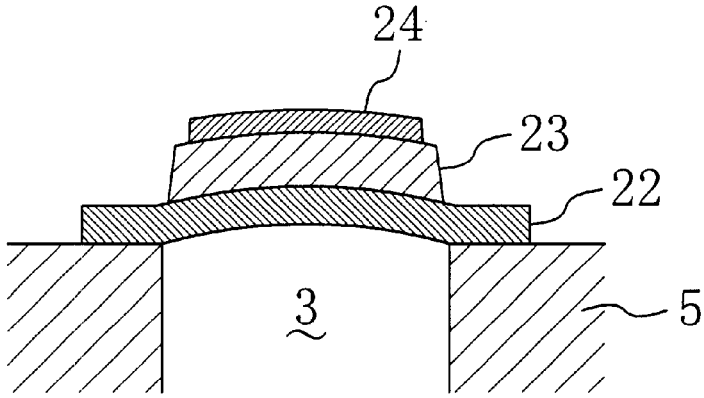

Next, the operation of the ink-jet head will be described. By applying a voltage between the vibration plate 22 and the individual electrode 24, the portion of the vibration plate 22 corresponding to the pressure chamber 3 can be deformed so as to reduce the volume of the pressure chamber 3, thereby discharging ink contained in the pressure chamber 3 through the discharge port 2*b*. In other words, when a pulse voltage is applied to the piezoelectric device 23 through the vibration plate 22 and the individual electrode 24, the piezoelectric device 23 shrinks in a lateral direction perpendicular to a thickness direction at a rise of the pulse voltage, but the vibration plate 22 does not shrink. Therefore, as is shown in FIG. 5(*b*), the portion of the vibration plate 22 corresponding to the pressure chamber 3 is deformed to displace toward the pressure chamber 3 (namely, so as to reduce the convex dimension). This deformation causes a pressure within the pressure chamber 3, and a predetermined amount of the ink contained in the pressure chamber 3 is discharged by this pressure through the discharge port 2*b* and the ink discharge passage 8 to be jetted externally (onto paper to be printed) through the nozzle hole 14, resulting in adhering onto the paper in the shape of dots. Then, at a fall of the pulse voltage, the piezoelectric device 23 elongates in the lateral direction, so that the vibration plate 22 can return to the original state (shown in FIG. 5(*a*)). At this point, fresh ink is filled in the pressure chamber 3 from the ink supply chamber 10 through the ink supply passage 7 and the supply port 2*a*. Not only ink of a single color but also ink of, for example, black, cyano, magenta and yellow can be respectively jetted through different nozzle holes 14, so as to realize color printing.

Figure 6A:
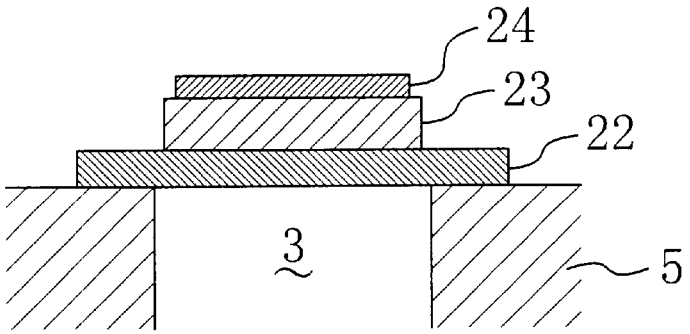
FIGS. 6(*a*) and 6(*b*) are enlarged views, similar to FIGS. 5(*a*) and 5(*b*) of a vibration plate in the shape of a flat plate.
Figure 6B:
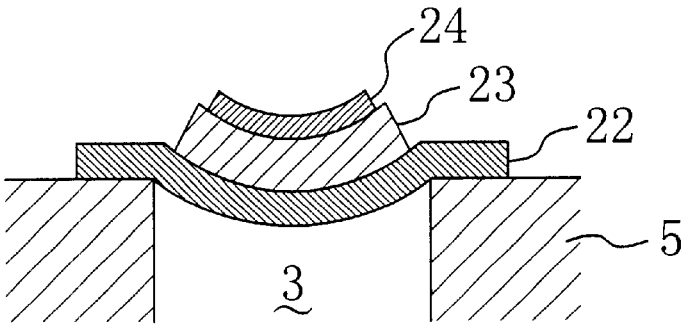
Figure 7A:
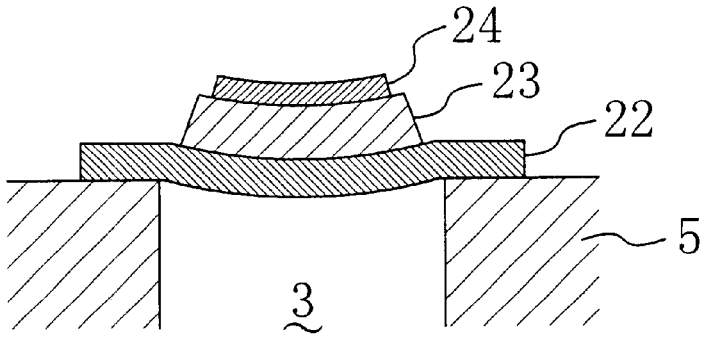
FIGS. 7(*a*) and 7(*b*) are enlarged views, similar to FIGS. 5(*a*) and 5(*b*) of a vibration plate that is bent into a convex projecting toward a pressure chamber.
Figure 7B:
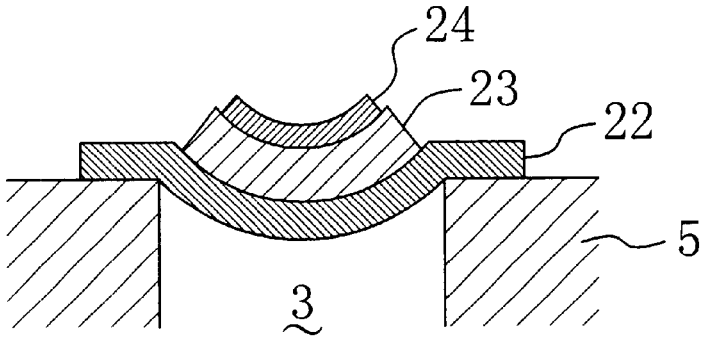
Figure 8A:
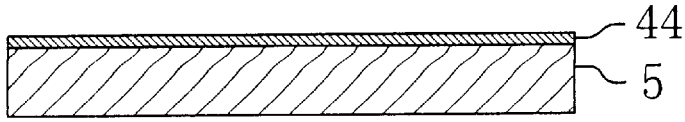
FIGS. 8(*a*) through 8(*f*) are schematic diagrams for showing another method of manufacturing the ink-jet head.
Figure 8B:
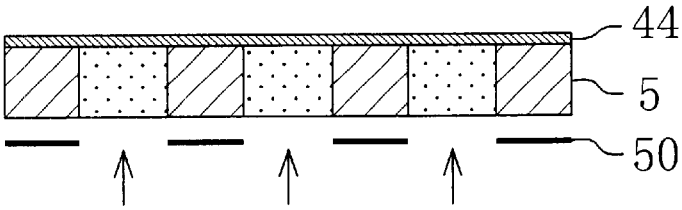
Figure 8C:
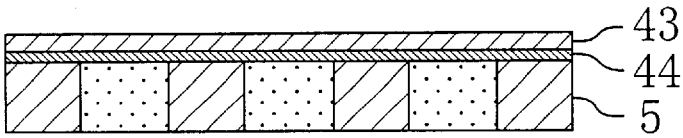
Figure 8D:
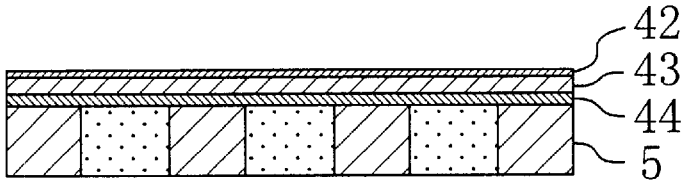
Figure 8E:
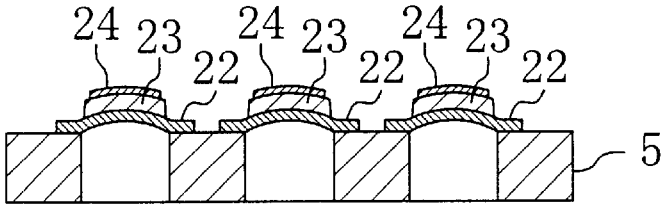
Figure 8F:
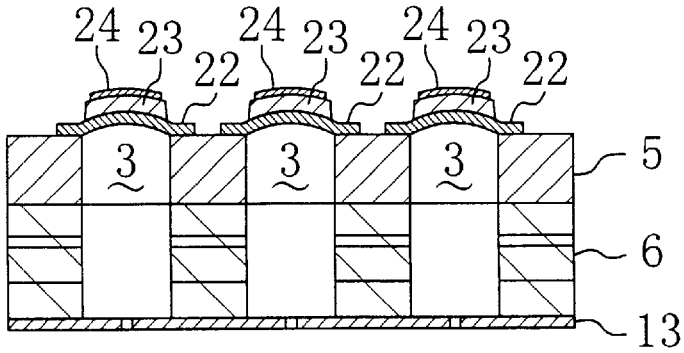

When the vibration plate 22 is deformed as described above, the piezoelectric device 23 is deformed together with the vibration plate 22 so as to receive a tensile force from the vibration plate 22. However, since the piezoelectric device 23 is initially bent into a convex projecting toward the opposite direction to the pressure chamber 3 to cause a compressive force, the tensile force and the compressive force cancel each other, resulting in making comparatively small a stress caused in the piezoelectric device 23. Specifically, when the vibration plate 22 and the piezoelectric device 23 are initially in the shape of a flat plate as is shown in FIG. 6(*a*) or initially bent into a convex projecting toward the pressure chamber 3 as is shown in FIG. 7(*a*), a tensile force caused in the piezoelectric device 23 when it is deformed (as is shown in FIGS. 6(*b*) and 7(*b*)) is so large that cracks can be easily caused in the piezoelectric device 23 very weak against a tensile force. Also, even when the deformation is small, power for jetting the ink can be made larger than in the case where the vibration plate 22 is flat or is bent into a convex projecting toward the pressure chamber 3, and hence, large deformation is not necessary. Furthermore, the separated vibration plates 22 do not mutually affect in the deformation, and hence, the mechanical strength of the vibration plate 22 can be prevented from lowering. Accordingly, the stress caused in deforming the vibration plates 22 and the piezoelectric devices 23 can be reduced in use of the ink-jet head, resulting in elongating the life thereof.

In the above-described embodiment, the filming substrate 41 is used for successively forming the Pt film 42, the PZT film 43 and the Cr film 44 by the sputtering thereon. However, the ink-jet head can be manufactured without using the filming substrate 41 by directly sputtering the respective films on the pressure chamber part 5 of photosensitive glass. This manufacturing method will be described with reference to FIGS. 8(*a*) through 8(*f*). First, the Cr film 44 is formed on the entire surface of the pressure chamber part 5 as is shown in FIG. 8(*a*). At this point, when the Cr film 44 is set to have a compressive force as the initial stress, the sputtering gas pressure and the like can be controlled as described in the aforementioned embodiment, or the Cr film 44 can be formed under application of a tensile force to the filming substrate 41 with the tensile force eliminated after the formation of the Cr film 44. Subsequently, a portion corresponding to each pressure chamber 3 is irradiated with UV exposure system through a mask 50 formed below the pressure chamber part 5 as is shown in FIG. 8(*b*). Then, after conducting a surface treatment, the PZT film 43 is formed on the entire Cr film 44 as is shown in FIG. 8(*c*) and the Pt film 42 is then formed on the entire PZT film 43 as is shown in FIG. 8(*d*). Next, the irradiated portions of the pressure chamber part 5 are removed through etching with a 3% HF solution, and unnecessary portions of the respective films are also removed through etching so as to separate them correspondingly to each of the pressure chambers 3. Thus, the vibration plate 22, the piezoelectric device 23 and the individual electrode 24 corresponding to each pressure chamber 3 can be formed as is shown in FIG. 8(*e*). Then, the ink passage part 6 and the nozzle plate 13 previously integrated are fixed on the lower surface of the pressure chamber part 5 as is shown in FIG. 8(*f*), thereby completing the ink-jet head. Also in this manufacturing method, when the irradiated portions of the pressure chamber part 5 are removed, the portions of the Pt film 42, the PZT film 43 and the Cr film 44 corresponding to each pressure chamber 3 can be bent into a convex projecting toward the opposite direction to the pressure chamber 3 as in the aforementioned embodiment. In addition, since the vibration plate 22 is separately provided to each pressure chamber 3, the same effect as that of the aforementioned embodiment can be attained.

Also in the aforementioned embodiment, the individual electrode 24, the piezoelectric device 23 and the vibration plate 22 are respectively formed by separating the Pt film 42, the PZT film 43 and the Cr film 44 correspondingly to each pressure chamber 3 by the dry etching. Alternatively, these films can be separated by a lift off method in which sputtering is conducted with unnecessary portions of the films previously coated with a resist.

Figure 9:
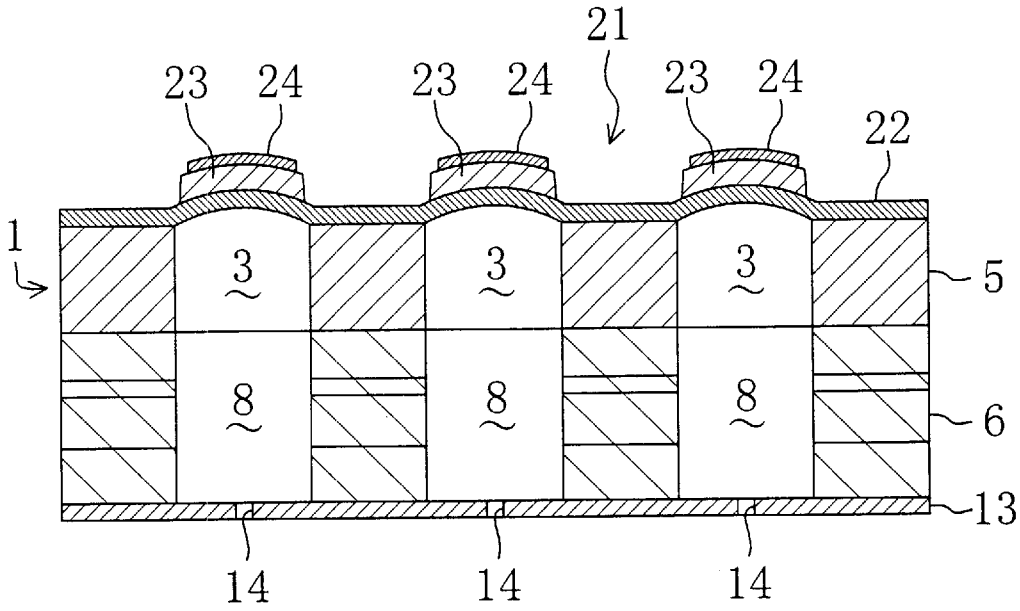
FIG. 9 is a sectional view, similar to FIG. 1, of an ink-jet head according to another embodiment.
Figure 10:
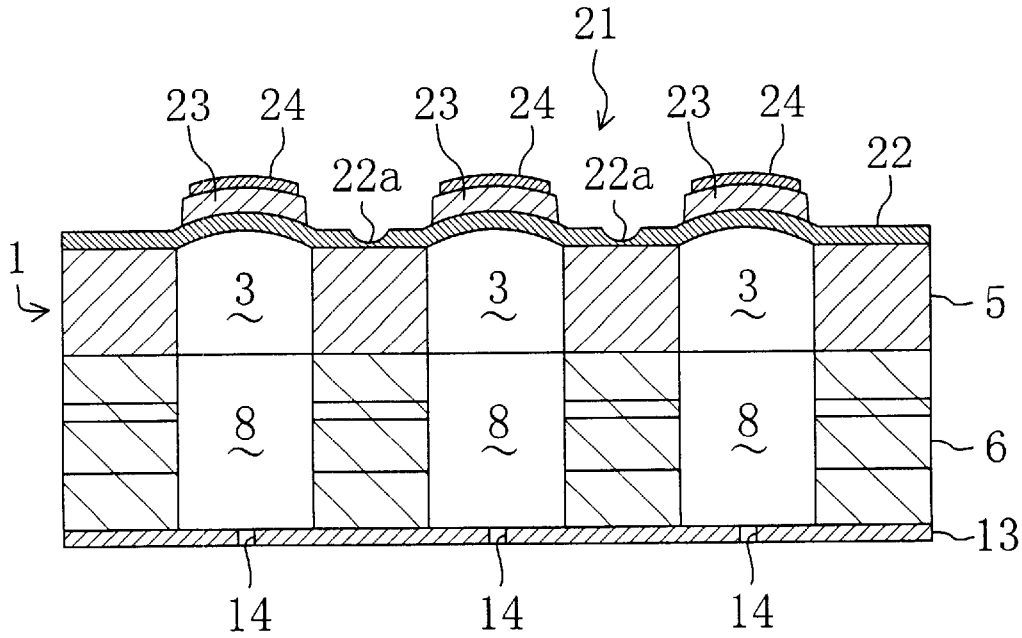
FIG. 10 a sectional view, similar to FIG. 1, of an ink-jet head according to still another embodiment.
Figure 11:
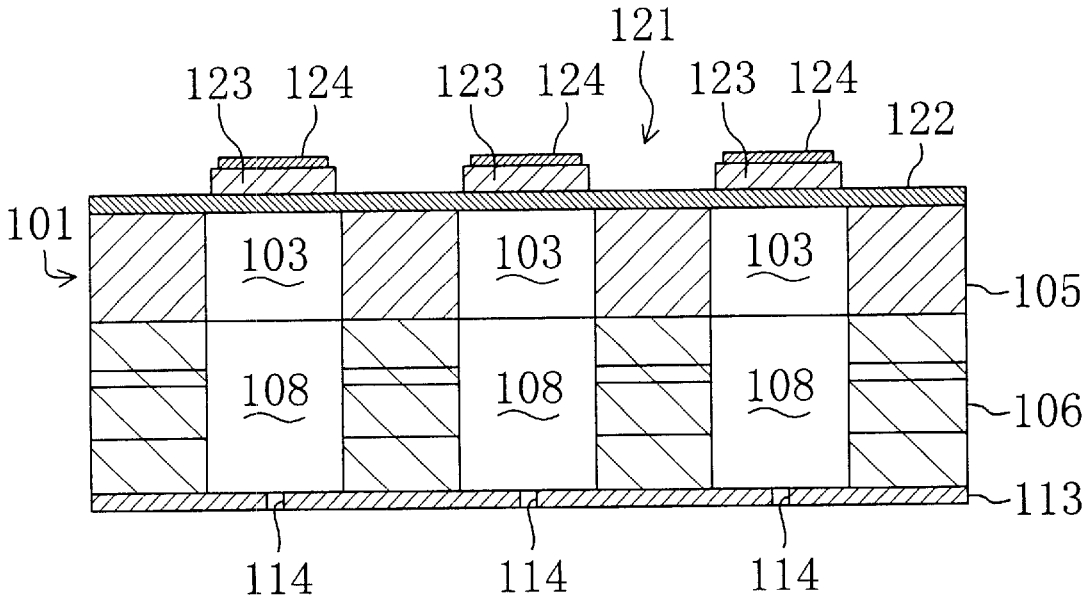
FIG. 11 is a sectional view of a conventional ink-jet head taken along a lateral direction of a vibration plate (specifically line XI—XI of FIG. 13)
Figure 12:
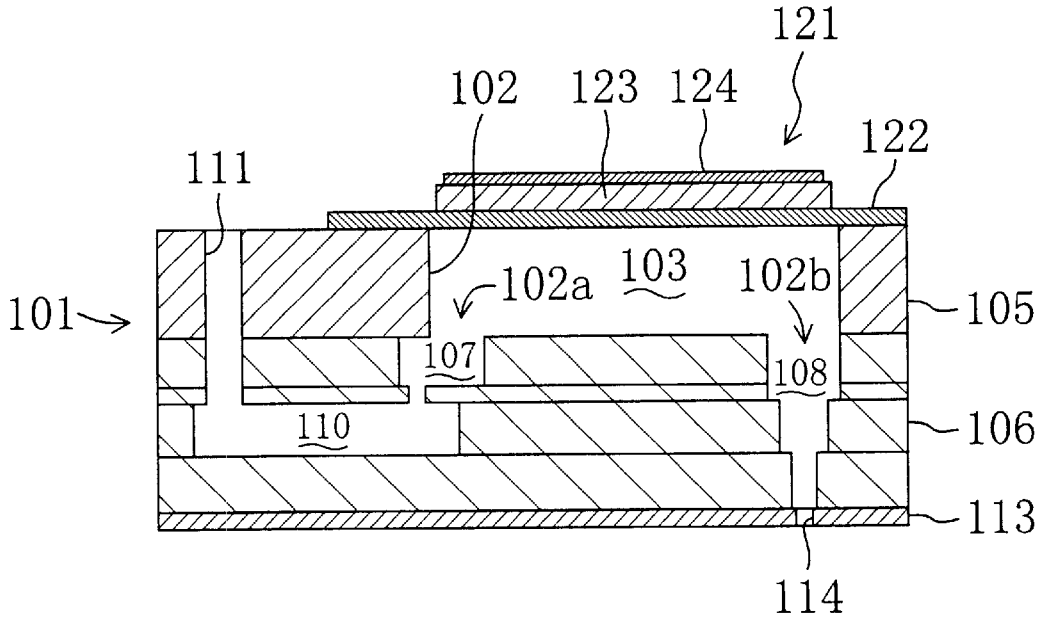
FIG. 12 is a sectional view of the conventional ink-jet head taken along a longitudinal direction of the vibration plate (specifically, line XII—XII of FIG. 13)
Figure 13:
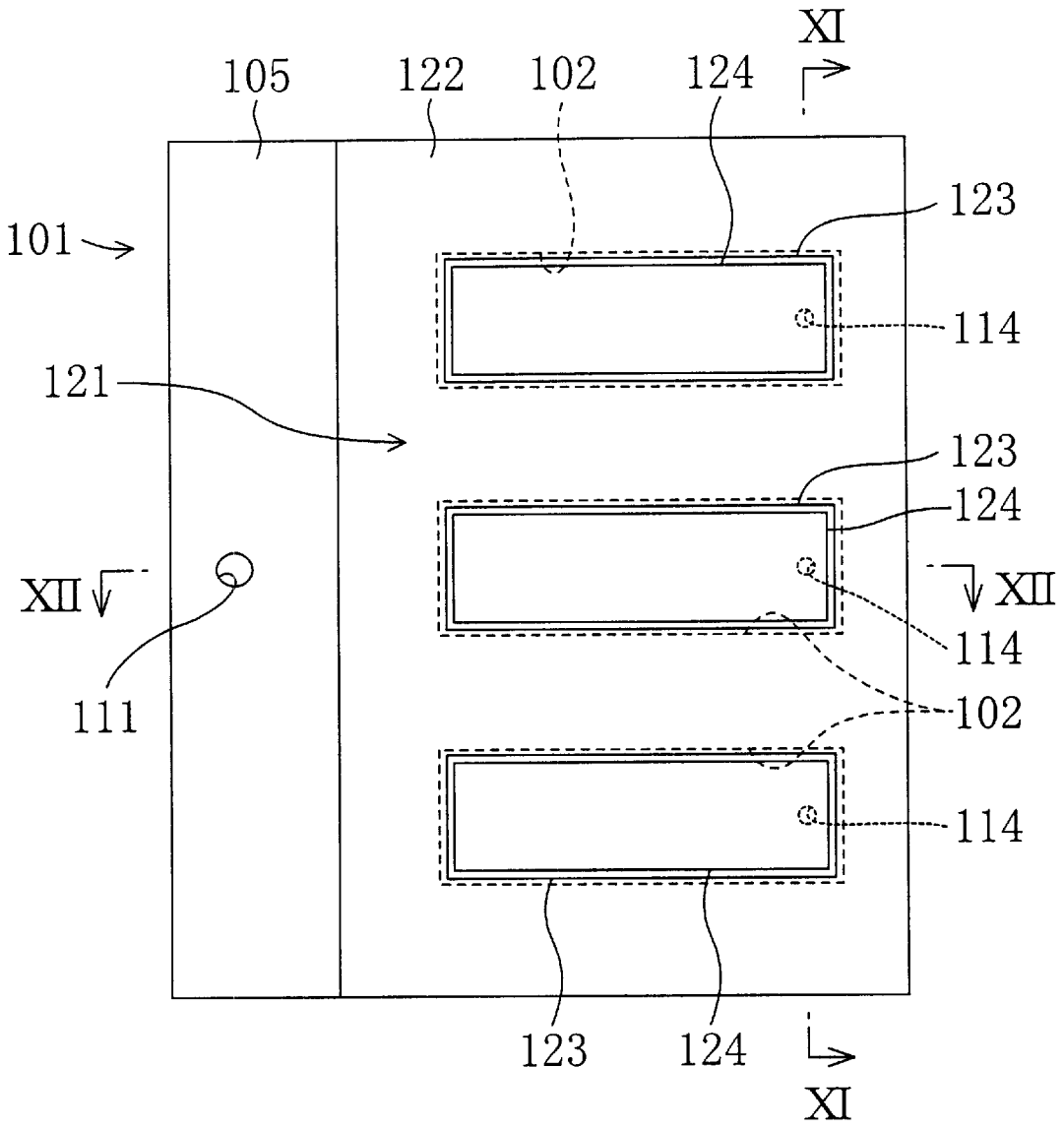
FIG. 13 is a plan view of the conventional ink-jet head.

Furthermore, the vibration plate 22 is separately provided on each pressure chamber 3 in the above-described embodiment. However, one vibration plate 22 can cover all the concaves 2 of the head body 1 as is shown in FIG. 9 and as in a conventional ink-jet head as far as the portion of the vibration plate 22 corresponding to each pressure chamber 3 is bent into a convex projecting toward the opposite direction to the corresponding pressure chamber 3. Also in this manner, the occurrence of cracks in the piezoelectric devices 23 in particular and further in the vibration plate 22 and the individual electrodes 24 can be suppressed as in the aforementioned embodiment. In addition, the stress caused in deforming the vibration plate 22 and the piezoelectric device 23 can be reduced in use of the ink-jet head, resulting in increasing the life thereof. Furthermore, one vibration plate 22 can be provided correspondingly to plural pressure chambers 3 (for example, pressure chambers 3 for containing ink of the same color in the case of color printing) instead of providing correspondingly to each pressure chamber 3. Alternatively, instead of providing one vibration plate 22 correspondingly to each pressure chamber 3 or plural pressure chambers 3, separated vibration plates 22 can be mutually connected through connect portions 22*a* thinner (with a minimum thickness of approximately 0.2 $\mu$m) than the vibration plate 22 as is shown in FIG. 10. The connect portion 22*a* is preferably formed integrally with the vibration plate 22 by shaving the surface of the vibration plate 22 facing the piezoelectric device 23 into a groove shape. In this manner, the vibration plates 22 can be mutually electrically connected without wiring, and can be placed in substantially the same mechanical and physical state as the completely separated vibration plates 22.

On the other hand, the portion of the vibration plate 22 corresponding to the pressure chamber 3 is not necessarily bent into a convex projecting toward the opposite direction to the pressure chamber 3 as far as the vibration plate 22 is separately provided correspondingly to one or plural pressure chambers 3. Specifically, the vibration plate 22 can be in the shape of a flat plate as is shown in FIG. 6(*a*) or can be bent into a convex projecting toward the pressure chamber 3 as is shown in FIG. 7(*a*). Even when the vibration plate is in such a shape, the occurrence of failures in the vibration plates 22 and the piezoelectric devices 23 can be suppressed in use or manufacture of the ink-jet head.

In addition, the shapes of each concave 2 and each piezoelectric device 23 of the piezoelectric actuator 21 are rectangular in the aforementioned embodiment, but they can be in an elliptical shape or any other shape.

Furthermore, various modifications can be made in the invention. For example, the materials and the thicknesses of the vibration plate 22, the piezoelectric device 23, the individual electrode 24 and the like of the piezoelectric actuator 21 can be different from those described in the embodiment (for example, the vibration plate 22 can be made from Ni or Ti) or these elements can be formed by methods different from those described above. Moreover, the materials and the thicknesses of the pressure chamber part 5, the ink passage part 6 and the nozzle plate 13 can be different from those described above.

Additionally, the bent shape of the vibration plate 22 is not specified as far as it is a convex projecting toward the opposite direction to the corresponding pressure chamber 3. However, the bent shape is preferably in a substantially arcuate shape as described in the embodiment in a section of the vibration plate 22 taken along the direction of extending the piezoelectric device 23 (in the lateral direction in the embodiment).

What is claimed is:

1. An ink-jet head comprising:

a head body including plural pressure chamber concaves each having a supply port for supplying ink and a discharge port for discharging ink; and a piezoelectric actuator including:

mutually electrically connected vibration plates that cover said concaves of said head body in order to form pressure chambers together with said concaves and are separately provided correspondingly to one or plural pressure chambers;

piezoelectric device respectively provided on surfaces of said vibration plates opposite to said pressure chambers correspondingly to said pressure chambers; and individual electrodes respectively provided on surfaces of said piezoelectric devices opposite to said vibration plates for applying a voltage to said piezoelectric devices together with said vibration plates, wherein said vibration plates are deformed in a manner that volumes of said pressure chambers are decreased by applying a voltage to said piezoelectric devices through said vibration plates and said individual electrodes, whereby ink contained in said pressure chambers is discharged through said discharge ports, and wherein a portion of each of said vibration plates corresponding to each of said pressure chambers is bent into a non-flat shape due to the internal stress action of each of said piezoelectric devices.

2. An ink-jet head comprising:

a head body including plural pressure chamber concaves each having a supply port for supplying ink and a discharge port for discharging ink; and a piezoelectric actuator including:

mutually electrically connected vibration plates that cover said concaves of said head body in order to form pressure chambers together with said concaves and are separately provided correspondingly to one or plural pressure chambers;

piezoelectric devices respectively provided on surfaces of said vibration plates opposite to said pressure chambers correspondingly to said pressure chambers; and individual electrodes respectively provided on surfaces of said piezoelectric devices opposite to said vibration plates for applying a voltage to said piezoelectric devices together with said vibration plates, wherein said vibration plates are deformed in a manner that volumes of said pressure chambers are decreased by applying a voltage to said piezoelectric devices through said vibration plates and said individual electrodes, whereby ink contained in said pressure chambers is discharged through said discharge ports, and wherein a portion of each of said vibration plates corresponding to each of said pressure chambers is bent into a convex projecting toward an opposite direction to said corresponding pressure chamber due to the compressive internal stress action of each of said piezoelectric devices.

3. The ink-jet head of claim 2, wherein said convex projecting toward the opposite direction to said corresponding pressure chamber has a maxium dimension of 0.05 through 10 $\mu$m.

4. An ink-jet head comprising:

a head body including plural pressure chamber concaves each having a supply port for supplying ink and a discharge port for discharging ink; and a piezoelectric actuator including:

a vibration plate covering said concaves of said head body in order to form pressure chambers together with said concaves and having a convex in a portion corresponding to each of said pressure chambers, said convex projecting toward an opposite direction to said corresponding pressure chamber;

piezoelectric devices provided on a surface of said vibration plate opposite to said pressure chambers respectively correspondingly to said pressure chambers; and individual electrodes respectively provided on surfaces of said piezoelectric devices opposite to said vibration plate for applying a voltage to said piezoelectric devices together with said vibration plate, wherein the portion of each of said vibration plates corresponding to each of said pressure chambers is deformed in a manner that the projecting dimension of said convex projecting toward an opposite direction to said corresponding pressure chamber is decreased, while said portion of each of said vibration plates maintained as said convex projecting toward an opposite direction to said corresponding pressure chamber, by applying a voltage to said piezoelectric devices through said vibration plate and said individual electrodes, whereby ink contained in said pressure chambers is discharged through said discharge ports.

5. The ink-jet head of claim 4, wherein said convex of said vibration plate projecting toward the opposite direction to said corresponding pressure chamber has a maximum dimension of 0.05 through 10 $\mu$m.

6. An ink jet head comprising:

a head body including plural pressure chamber concaves each having a supply port for supplying ink and a discharge port for discharging ink; and a piezoelectric actuator including:

mutually electrically connected vibration plates that cover said concaves of said head body in order to form pressure chambers together with said concaves and are separately provided correspondingly to one or plural pressure chambers;

piezoelectric devices respectively provided on surfaces of said vibration plates opposite to said pressure chambers correspondingly to said pressure chambers; and individual electrodes respectively provided on surfaces of said piezoelectric devices opposite to said vibration plates for applying a voltage to said piezoelectric devices together with said vibration plates, wherein said vibration plates are deformed in a manner that volumes of said pressure chambers are decreased by applying a voltage to said piezoelectric devices through said vibration plates and said individual electrodes, whereby ink contained in said pressure chambers is discharged through said discharge ports, and wherein a portion of each of said vibration plates corresponding to each of said pressure chambers is bent in a convex projecting toward an opposite direction to said corresponding pressure chamber and the thickness of said piezoelectric devices are set between 2 to 5 $\mu$m.

* * * * *